United States Patent [19]

Ogawa

[11] Patent Number: 4,529,239

[45] Date of Patent: Jul. 16, 1985

[54] GRAPPLE ATTACHMENT FOR LOG LOADER

[76] Inventor: Junji Ogawa, No. 22-13, 2-Chome, Hagioka, Hamamatsu-Chi, Shizuoka-Ken 430, Japan

[21] Appl. No.: 550,335

[22] Filed: Nov. 9, 1983

[30] Foreign Application Priority Data

Nov. 16, 1982 [JP] Japan ..... 57-172302[U]

[51] Int. Cl.[3] ..... B66F 9/18

[52] U.S. Cl. ..... 294/88; 294/104; 294/67.22; 414/622; 414/740

[58] Field of Search ..... 294/63 R, 67 R, 67 A, 294/67 AA, 67 AB, 67 B, 67 BB, 67 BC, 67 D, 67 DA, 67 DB, 81 R, 81 SF, 88, 104–107; 414/23, 618–623, 729, 732, 738–740

[56] References Cited

U.S. PATENT DOCUMENTS

| | | | |
|---|---|---|---|
| 1,895,939 | 1/1933 | Presbrey | 294/63 R X |
| 2,681,741 | 6/1954 | Bickerstaff | 414/623 |
| 2,776,768 | 1/1957 | Carlson | 414/732 |
| 3,034,820 | 5/1962 | Schwartz et al. | 294/88 |
| 3,203,566 | 8/1965 | Kampert et al. | 294/88 X |
| 3,332,716 | 7/1967 | Gridley | 294/67 R |
| 4,266,819 | 5/1981 | Pemberton | 294/88 |

FOREIGN PATENT DOCUMENTS

| | | | |
|---|---|---|---|
| 380577 | 7/1973 | U.S.S.R. | 294/67 A |

*Primary Examiner*—Johnny D. Cherry

*Attorney, Agent, or Firm*—Armstrong, Nikaido, Marmelstein & Kubovcik

[57] ABSTRACT

A grapple attachment for log loader of a type in which a main frame comprises a pair of tines integrally joined to and extended forwardly from both lateral ends at the bottom thereof and a pair of clamp arms each pivoted on both lateral ends at the top thereof and driven vertically rotatably by a hydraulic cylinder and piston means, is improved according to this invention in that the main frame comprises a pair of support posts disposed on both lateral ends thereof and a beam assembly generally of an X-shaped configuration disposed between the support posts for connecting the same. The X-shaped beam may be of a hollow structure reinforced with web members such as lattice bars integrally secured to the inside of the hollow beam. In a modified embodiment, the pivotal structure for the clamp arm disposed on each of the support posts is formed with a multi-forked bracket composed of three or more equispaced bracket plates, which rotatably receive the pivotal end plates of the clamp arm in the corresponding bracket spaces respectively.

5 Claims, 2 Drawing Figures

GRAPPLE ATTACHMENT FOR LOG LOADER

BACKGROUND OF THE INVENTION

1. Field of the Invention

This invention relates to an improvement in a grapple attachment for log loader for use in carrying out logs or lumbers.

2. Description of the Prior Art

Conventional grapple attachments for log loader basically comprise a main frame connected to a driving arm of a log loader or similar civil engineering machine, a pair of tines or fork members integrally secured to and extended forwardly from both lateral ends at the lower part of the vertically erected main frame, and a pair of clamp arms pivoted to both lateral ends at the upper part of the main frame such that they are vertically rotated by adequate means, e.g., hydraulic cylinders to and from the tines in order to carry out logs or lumbers clamped between the tines and the clamp arms.

Since most of such conventional grapple attachments for log loader have been intended to carry out logs or lumbers already stacked orderly and transfer them, for instance, in the vertical direction while carrying them on the tines, they have been designed such that the main frame for supporting the tines and the clamp arms has a beam assembly comprising vertical and lateral beams connected to each other in a grid-like structure, and the base end for each of the clamp arms is pivotally received between a biforked axle-bearing bracket disposed to the upper part of the main frame.

As the result, although the grapple attachment of such a conventional design can readily withstand the loads exerted uniformly on the main frame along with the extending directions of the beam such as in the vertical direction, its structural strength is extremely poor against those loads which are exerted locally or at random. Particularly, upon actual use of such a grapple attachment for log loader, for example, in the deforestating field or the like, the grapple attachment is often operated under rather irregular and severe working conditions. For instance, a cut down tree or log is sometimes held between the tine and the clamp arm only on one side of the main frame in a so-called canti-levered manner and dragged out forcibly. This may cause locally concentrated stress or obliquely oriented force to the base of the main frame, thereby possibly resulting in cracks to the main frame at the connections of the beam members thereof, which may readily lead to the structural damages such as deforming of the main frame and undesirable disordering in the parallel positional relationship between the opposing tines and clamp arms. Furthermore, the biforked axle-bearing brackets pivotally receiving the clamp arms, when exposed to such irregular and severe working states, tend to warp outwardly and frequently develop cracks or flexures in these portions.

SUMMARY OF THE INVENTION

A principal object of this invention is to provide a grapple attachment for log loader with a structure capable of withstanding those loads not only applied uniformly or regularly throughout the main frame but also those loads applied irregularly or at random which may cause an oblique force or concentrated stress, by providing a beam assembly generally of an X-shaped configuration between the support posts on both lateral ends of a main frame for supporting the tines and the clamp arms.

Another object of this invention is to provide a grapple attachment for log loader with improved structural strength by designing the X-shaped beam assembly as a hollow structure and reinforcing the interior thereof with web members.

A still further object of this invention is to provide a grapple attachment for log loader with further improved overall mechanical strength by the reinforcement of the clamp-bearing pivotal structure of the support posts in addition to the aforementioned improved X-like beam configuration and the specific structure for such beam assembly.

BRIEF DESCRIPTION OF THE DRAWINGS

These and other objects, as well as the advantageous features of this invention will become clearer by the descriptions of preferred embodiments according to this invention referring to the accompanying drawings, in which.

DETAILED DESCRIPTION OF THE PREFERRED EMBODIMENT OF THIS INVENTION

Figure 1:
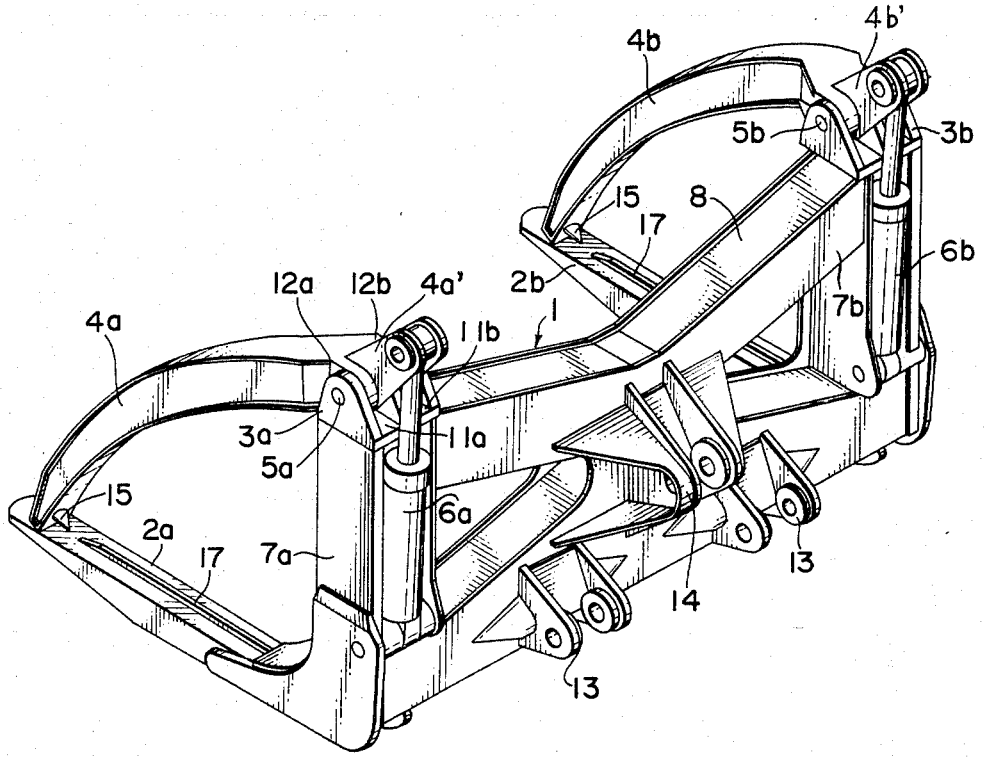
FIG. 1 is a perspective view of a grapple attachment for log loader as a preferred embodiment of this invention.

The grapple attachment for log loader illustrated in FIG. 1 comprises a main frame 1, a pair of tines or fork members 2*a*, 2*b* integrally formed to and extended forwardly from the bottom of the main frame 1 at the lateral ends, that is, at the right and left sides thereof, pivotal bracket plates 3*a*, 3*b* formed respectively to the right and left sides at the top of the main frame 1 and a pair of clamp arms 4*a*, 4*b* pivotally received in the bracket plates 3*a*, 3*b* by means of pins 5*a*, 5*b* respectively so as to be vertically rotatable to and from the tines 2*a*, 2*b*. Respective pivotal ends 4*a*′, 4*b*′ of the clamp arms 4*a*, 4*b* are extended past the pivotal points at the bracket plates 3*a*, 3*b* for connecting with the stroke ends of hydraulic cylinders 6*a*, 6*b* mounted vertically at the main frame 1, so that the clamp arms 4*a*, 4*b* are rotationally driven by the reciprocation of the hydraulic cylinders 6*a*, 6*b* for approaching to and parting from the tines 2*a*, 2*b*.

The main frame 1 comprises a pair of support posts 7*a*, 7*b* disposed on the right and left sides and the tines 2*a*, 2*b* are extended forwardly from the bottom of the posts respectively. A beam assembly is integrally connected between the support posts 7*a*, 7*b* to constitute the main frame 1. The beam assembly comprises a beam 8 generally of an X-shaped configuration, which forms a major feature of this invention. Specifically, two beam members crossing to each other on a same plane are integrally joined at the crossing portion and the respective leg ends of the beam members are connected to the top and bottom ends of both of the support posts 7*a*, 7*b*.

In the drawing, a bracket 13 for the pivotal connection with a drive arm of a log loader or other civil engineering machine (not shown) and brackets 14 for connection with hydraulic cylinders (not shown) on the side of the log loader are secured at the back of the main frame 1. A finger 15 for hooking a log or lumber is secured to the inner side at the top end of each clamp arm 4*a*, 4*b* in order to surely clamp the log with no slipping. Further, an anti-slip ridge 17 is integrally protruded on the upper surface of each tine 2*a*, 2*b*, for securing the log with no lateral slipping and also for preventing the abrasion of the tine. Each component of the grapple attachment is made of hard and tough material such as steel in this embodiment.

As described above, according to the present embodiment of this invention, since the beam 8 disposed between the support posts 7*a*, 7*b* as the fundamental component of the main frame 1 for the log-form attachment is formed into a generally X-shaped configuration, structural strength of the attachment can be improved significantly, in particular, against those loads applied at random or irregularly. For instance, in a case where a log is caught between the tine and the clamp arm only on one side of the main frame and laterally dragged out forcibly in a so-called canti-levered manner, which is often experienced in actual operation of the grapple attachment such as in deforestation, the log will exert random or irregular loads to the main frame tending to twist or deform the attachment due to obliquely oriented forces or locally concentrated stresses. However, such loads or forces can be distributed along each of the obliquely oriented legs of the X-shaped beam 8 and the stresses which otherwise would be concentrated locally can be dispersed throughout the main frame 1 in the present embodiment. Consequently, the novel and unique X-shaped design of the beam assembly in this invention can provide the grapple attachment with a much improved structural strength, particularly, against those loads applied irregularly or obliquely, which have not been expected in the prior art design of the grapple attachments for log loader and hence often caused damages thereto.

The X-shaped structure of the beam 8 in this embodiment can further provide an additional merit. In the conventional grapple attachment, the grid-like beam assembly of the main frame has often hindered or narrowed the forward sight of a loader operator manipulating the grapple attachment from operator's seat located on the vehicle behind the main frame. However, the X-shaped beam 8 of the main frame 1 in the present invention enables the operator to observe the working status of the grapple attachment, particularly, at the log clamping portion between the tines 2*a*, 2*b* and the clamp arms 4*a*, 4*b* on either of the sides of the main frame 1 through larger spaces defined between the legs of the X-shaped beam 8 which are gradually diverged toward right and left sides of the main frame. This ensures the operator more reliable and safer manipulation of the grapple attachment thus leading to an improved working efficiency.

As described above, while the X-shaped beam 8 can increase the structural strength of the main frame 1, the strength of the beam 8 per se can further be increased by making the beam into a specific structure.

Figure 2:
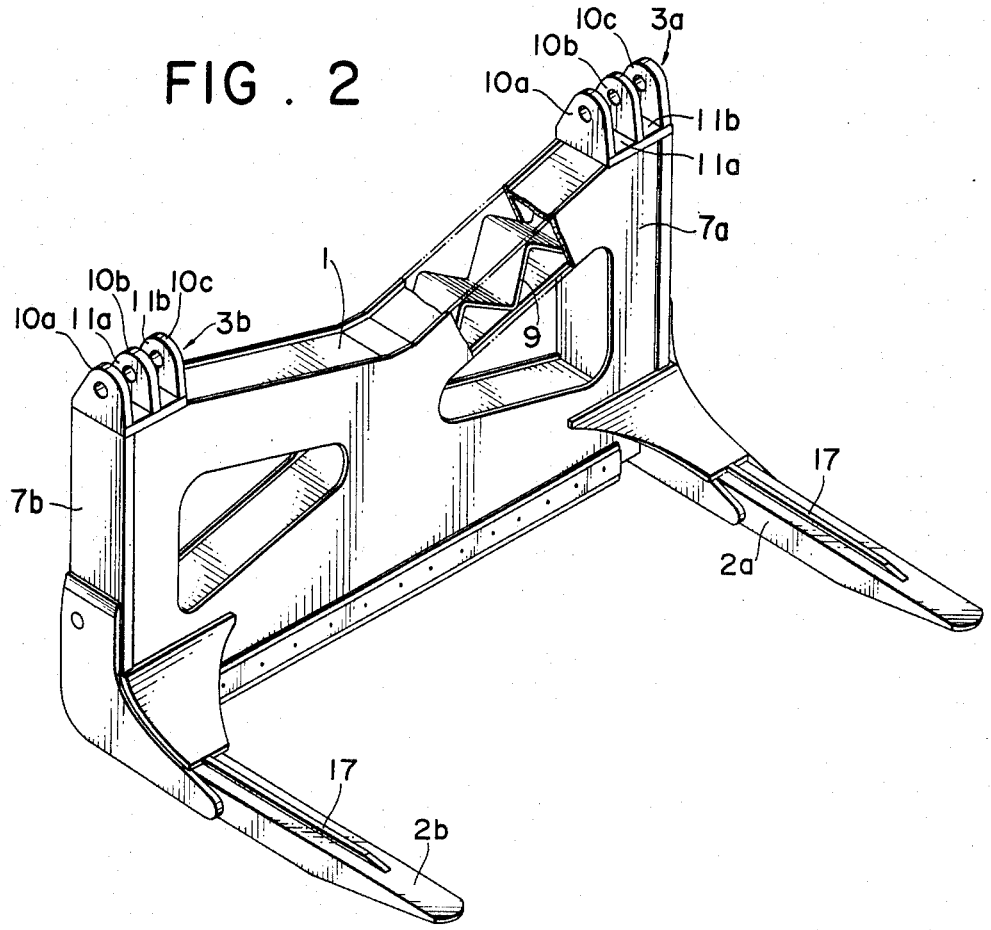
FIG. 2 is a perspective view of a grapple attachment as another preferred embodiment of this invention, in which the details of the beam structure and the clamp-bearing pivotal structure on the support post are shown while removing the clamp arms.

FIG. 2 show another embodiment of the grapple attachment for log loader with a modified beam structure according to this invention.

As shown in FIG. 2, the X-shaped beam 8 has a hollow or tubular structure, and a corrugated reinforcing member 9 is disposed in the cavity and integrally bonded to the inner wall of the beam 8 in the front of a so-called lattice beam or trussed beam. This hollow and reinforced structure of the beam 8 can render the beam 8 much more resistive to the twisting, deforming or like other external forces.

The modified embodiment shown in FIG. 2 further includes a structural improvement in the pivotal portion of the support posts, which are most liable to undergo deformation or flexure due to jerking or twisting forces as described above.

In the embodiment shown in FIG. 2, the pivotal portion, that is, the axle-bearing bracket plates 12*a*, 12*b* disposed to each of the support posts 7*a*, 7*b* for pivotally receiving the clamp arms 4*a*, 4*b* are replaced with three bracket plates 10*a*, 10*b*, 10*c* which are made of cast steels and juxtaposed in parallel with each other with an equal lateral interval. Specifically, the three bracket plates 10*a*, 10*b*, 10*c* are integrally erected from each of the support posts 7*a*, 7*b* at a predetermined parallel interval between each other so as to form forked recesses 11*a*, 11*b*.

While on the other hand, each of the rearwardly extended pivotal ends of the clamp arms 4*a*, 4*b* (shown in FIG. 1) are correspondingly formed into biforked protrusion (similar to the pivotal ends 12*a*, 12*b* shown in FIG. 1), engaged into each of the mating biforked recesses 11*a*, 11*b* of the bracket plates 10*a*, 10*b*, 10*c* respectively and secured pivotally by means of pins 5*a*, 5*b* (also as shown in FIG. 1). In this way, since each of the support posts 7*a*, 7*b* supports the pivotal ends 12*a*, 12*b* for each of the clamp arms 4*a*, 4*b* between the three bracket plates 10*a*, 10*b*, 10*c* instead of two in the former structure, the mechanical strength of the pivotal portion can further be improved. Although three bracket plates 10*a*, 10*b*, 10*c* are disposed in the illustrated embodiment, the number of the bracket plates disposed on the support posts 7*a*, 7*b* may, alternatively, be four or more, and the number of the pivotal plates of the clamp arm 4*a*, 4*b* may be three or more correspondingly, so long as the mechanical strength of the pivotal portion may be enhanced by such a multi-forked pivotal structure.

As described above, according to the illustrated embodiment of this invention, since the beam assembly as the structural component for the main frame of the grapple attachment for log loader has a novel and unique X-shaped configuration, a significantly improved structural strength can be obtained particularly against those loads applied irregularly or locally, which have not been considered in the prior art design for the grapple attachment but often experienced in actual working.

In addition, the hollow and reinforced structure employed for the X-shaped beam can further improve the structural strength.

Furthermore the multi-forked pivotal structure of the support post for pivotally receiving the clamp arm can provide the pivotal portion with more improved strength and protection against deformation or flexure caused by the application of the aforementioned irregular or concentrated loads.

Accordingly, this invention provides a grapple attachment for log loader which has a remarkably improved structure strength with much reduced possibility of failures and can be operated efficiently with less maintenance or repair.

What is claimed is:

1. A grapple attachment for a log loader comprising:

(a) a main frame consisting essentially of a lower member which forms a frame base, said lower member having a bottom surface extending essentially horizontally across a width of the frame and an upper surface which defines with the bottom surface a generally triangular shape in elevational view, and having a mid-portion being farther above the bottom surface than at either end, two vertical members attached to said lower member at each end of the lower member at an angle of 90° to said bottom surface, and two upper members each being attached to and projecting inwardly from an upper portion of one of said vertical members in a plane defined by the lower member and one vertical member, at an angle to the vertical members such that the upper members are integrally connected to and intersect said mid-portion of the lower member;

(b) brackets disposed on one side of said main frame for connection to a motorized vehicle;

(c) a pair of tines integrally joined to and extended from both lateral ends of said lower member, projecting in a direction opposite to that of said brackets;

(d) a pair of clamp arms each pivoted on a top of one of said vertical members and each projecting in a plane defined by its vertical member and the tine attached thereto, and (e) hydraulically actuated means attached at one end thereof to said main frame and at the opposite end thereof to said clamp arms for rotating said clamp arms.

2. The grapple attachment according to claim 1, wherein at least one of said main frame lower, vertical, and upper members are formed of hollow beams containing reinforcing members disposed therein.

3. The grapple attachment according to claim 2, wherein the reinforcing members disposed therein comprise one or more corrugated lattice plates.

4. The grapple attachment according to claim 1, wherein the upper surfaces of the lower member and at least one surface of each upper member form an "X".

5. A grapple attachment according to claim 1, wherein the pivot for each clamp arm comprises a fixed bracket comprised of at least 3 bracket plates attached to the top of said vertical members with a predetermined lateral recess between each plate and a movable bracket attached to said clamp arm bearing one fewer plates than said fixed bracket, and a hinge pin interconnecting said brackets.

* * * * *